US009581056B2

(12) United States Patent
Koyama et al.

(10) Patent No.: US 9,581,056 B2
(45) Date of Patent: Feb. 28, 2017

(54) VALVE SEAT

(75) Inventors: Yoshio Koyama, Gifu (JP); Fusanobu Hanada, Gifu (JP); Shohtaroh Hara, Gifu (JP)

(73) Assignee: TPR CO., LTD., Tokyo (JP)

( * ) Notice: Subject to any disclaimer, the term of this patent is extended or adjusted under 35 U.S.C. 154(b) by 0 days.

(21) Appl. No.: 14/361,182

(22) PCT Filed: Jun. 14, 2012

(86) PCT No.: PCT/JP2012/065196

§ 371 (c)(1),
(2), (4) Date: Oct. 6, 2014

(87) PCT Pub. No.: WO2013/080591

PCT Pub. Date: Jun. 6, 2013

(65) Prior Publication Data

US 2015/0047596 A1 Feb. 19, 2015

(30) Foreign Application Priority Data

Nov. 29, 2011 (JP) ..... 2011-260337

(51) Int. Cl.
*F01L 3/02* (2006.01)
*F01L 3/22* (2006.01)
(Continued)

(52) U.S. Cl.
CPC ..... *F01L 3/02* (2013.01); *B22F 5/008* (2013.01); *B22F 5/106* (2013.01);
(Continued)

(58) Field of Classification Search
CPC ..... B22F 5/008; B22F 1/0003; B22F 3/10; B22F 3/12; B22F 7/06; B22F 2003/242;
(Continued)

(56) References Cited

U.S. PATENT DOCUMENTS 4,204,031 A * 5/1980 Takemura ..... C22C 33/0207 419/11
6,082,317 A * 7/2000 Takahashi ..... F01L 3/22 123/188.3
(Continued)

FOREIGN PATENT DOCUMENTS

CN 1517518 A 8/2004
JP 54-173117 12/1979
(Continued)

OTHER PUBLICATIONS

International Search Report for Application No. PCT/JP2012/065196 mailed Sep. 11, 2012.
(Continued)

*Primary Examiner* — Long T Tran
(74) *Attorney, Agent, or Firm* — Smith, Gambrell & Russell, LLP.

(57) ABSTRACT

Provided is a valve seat having excellent strength and wear resistance. In a valve seat using an iron-based sintered alloy, an oxide mains composed of triiron tetroxide is formed by oxidation treatment on the surface and interior of the iron-based sintered alloy, and the average area ratio of the oxide mainly composed of triiron tetroxide in a cross section of the iron-based, sintered alloy in the state prior to installation on a cylinder head is 5 to 20%. Preferably, the iron-based sintered alloy contains hard particles formed from at least one compound of carbides, silicides, nitrides, borides, and intermetallic compounds containing one or more elements selected from groups 4*a* to 6*a* of the periodic table, and the average area ratio of the hard particles in the cross section of the iron-based sintered alloy in the state prior to installation on a cylinder head is 5 to 45%.

4 Claims, 8 Drawing Sheets

(51) Int. Cl.
*B22F 5/00* (2006.01)
*B22F 5/10* (2006.01)
*C22C 33/02* (2006.01)

(52) U.S. Cl.
CPC ..... *C22C 33/0278* (2013.01); *F01L 3/22* (2013.01); *C22C 33/025* (2013.01); *C22C 33/0292* (2013.01); *F01L 2101/00* (2013.01)

(58) Field of Classification Search
CPC . F01L 3/02; F01L 2101/00; F01L 3/04; F01L 2820/01; C22C 33/0285; C22C 38/60; Y10T 29/49306; Y10T 428/12042; B21K 1/24; F16K 1/42; F16K 25/005
USPC ..... 123/188.8, 188.1, 188.11; 276/231, 236, 276/246; 419/14, 19, 27
See application file for complete search history.

(56) References Cited

U.S. PATENT DOCUMENTS 6,318,327 B1 * 11/2001 Takahashi ..... F01L 3/02 123/188.3
7,273,508 B2 * 9/2007 Sato ..... C22C 1/02 75/243
2001/0018852 A1 * 9/2001 Ando ..... C22C 33/0207 75/228
2004/0187830 A1 9/2004 Sato et al.
2005/0193861 A1 * 9/2005 Sato ..... C22C 1/02 75/246
2007/0101964 A1 * 5/2007 Morimoto ..... B22F 3/24 123/188.8
2011/0023808 A1 * 2/2011 Sato ..... C22C 1/0491 123/188.8

FOREIGN PATENT DOCUMENTS

| | | |
|---|---|---|
| JP | 55-87809 | 7/1980 |
| JP | 60-224760 A | 11/1985 |
| JP | 02-277905 | 11/1990 |
| JP | 07-133705 | 5/1995 |
| JP | 10-081902 | 3/1998 |
| JP | 2000-054087 | 2/2000 |
| JP | 2004-232088 | 8/2004 |
| KR | 10-1046418 | 7/2011 |

OTHER PUBLICATIONS

Supplementary Extended European Search Report for PCT/JP2012065196 dated Oct. 13, 2015.
Chinese Patent Office Action dated Oct. 23, 2015.

* cited by examiner

*ANNOTATION: FOR THE SURFACE CROSS-SECTIONAL STRUCTURE, OXYGEN IN THE EMBEDDED RESIN WAS DETECTED; THEREFORE, AN OXYGEN ANALYSIS WAS NOT PERFORMED FOR THE OBJECT.

*ANNOTATION: FOR THE SURFACE CROSS-SECTIONAL STRUCTURE, OXYGEN IN THE EMBEDDED RESIN WAS DETECTED; THEREFORE, AN OXYGEN ANALYSIS WAS NOT PERFORMED FOR THE OBJECT.

*ANNOTATION: FOR THE SURFACE CROSS-SECTIONAL STRUCTURE, OXYGEN IN THE EMBEDDED RESIN WAS DETECTED; THEREFORE, AN OXYGEN ANALYSIS WAS NOT PERFORMED FOR THE OBJECT.

*ANNOTATION: FOR THE SURFACE CROSS-SECTIONAL STRUCTURE, OXYGEN IN THE EMBEDDED RESIN WAS DETECTED; THEREFORE, AN OXYGEN ANALYSIS WAS NOT PERFORMED FOR THE OBJECT.

VALVE SEAT

TECHNICAL FIELD

The present invention relates to a valve seat using an iron-based sintered alloy.

BACKGROUND ART

A valve seat is a part that serves as a seat of an air valve or an exhaust valve, the part being connected to the valve and needed for maintaining air-tightness of a combustion chamber.

A valve seat has the following requirements: (1) a function of maintaining air-tightness in order to prevent leakage of compressed gas or combustion gas into a manifold; (2) a heat-conducting function for allowing heat in the valve to escape toward the cylinder head; (3) sufficient strength to withstand impact on the valve during seating; and (4) a wear-resistance function minimizing wear even in high-heat and high-load environments.

Additional required characteristics of a valve seat include: (5) lacking aggressiveness to the associated valve; (6) having a reasonable cost; and (7) being easy to scrape during processing.

An iron-based sintered alloy therefore is used in a valve seat so as to satisfy the functions and characteristics stated above.

For example, patent document 1 discloses a valve seat made of an iron-based sintered alloy, in which voids are filled with an organic compound and at least the outer perimeter surface is sealed with triiron tetroxide.

Patent 2 discloses a valve seat containing an iron-based sintered alloy, in which the iron-based sintered alloy is used as a base material and the surface is covered with an iron oxide film mainly composed of triiron tetroxide.

PRIOR ART DOCUMENTS

Patent Documents

[Patent Document 1] Japanese Laid-Open Utility Model Application No. S54-173117

[Patent Document 2] Japanese Laid-Open Patent Application No. H7-133705

DISCLOSURE OF THE INVENTION

Problems to Be Solved by the Invention

In the abovementioned patent documents 1 and 2, the iron-based sintered alloy is oxidation treated to form an iron oxide layer on the surface, whereby wear resistance of the valve seat is improved.

However, based on research by the present inventors, it was learned that the strength of a valve seat is greatly influenced by the quantity of oxide formed inside the iron-based sintered alloy. In patent documents 1 and 2, there is no study at all concerning the quantity of oxide formed inside the iron-based sintered alloy, and there was a possibility that strength degradation may occur.

An object of the present invention therefore is to provide a valve seat containing an iron-based sintered alloy and having excellent strength and wear resistance.

Means to Solve the Problems

The inventors perfected the present invention upon discovering, as a result of various studies, that wear resistance can be improved while maintaining strength, by forming an oxide mainly composed of triiron tetroxide on the surface and interior of an iron-based sintered alloy and controlling the ratio of the oxide mainly composed of triiron tetroxide inside the iron-based sintered alloy to a specific range.

Specifically, the valve seat of the present invention is a valve seat using an iron-based sintered alloy, in which: an oxide mainly composed of triiron tetroxide is formed by oxidation treatment on the surface and interior of the iron-based sintered alloy; and the average area ratio of the oxide mainly composed of triiron tetroxide in a cross section of the iron-based sintered alloy in the state prior to installation on a cylinder head is 5 to 20%.

According to the valve seat of the present invention, because the oxide mainly composed of triiron tetroxide is formed on the surface and interior of the iron-based sintered alloy, an oxide is easily formed on the surface contacting with a valve during operation, with the oxide formed in advance on the surface of the iron-based sintered alloy as a starting point. By forming the oxide on the surface contacting with the valve, metal contact between the valve and the valve seat is suppressed and wear resistance of the valve seat is improved. By controlling the average area ratio of the oxide mainly composed of triiron tetroxide in across section of the iron-based sintered alloy to 5 to 20%, the wear resistance can be improved while maintaining strength.

In the valve seat of the present invention, the iron-based sintered alloy preferably contains hard particles formed from at least one compound of carbides, silicides, nitrides, borides, and intermetallic compounds containing one or more elements selected from groups 4a to 6a of the periodic table; and the average area ratio of the hard particles in the cross section of the iron-based sintered alloy in the state prior to installation on a cylinder head is preferably 5 to 45%. According to this aspect, plastic flow of the iron-based sintered alloy is suppressed by the hard particles and the wear resistance is further improved.

In the valve seat of the present invention, the hardness of the hard particles is preferably 600 to 1600 HV

Advantageous Effects of the Invention

According to the present invention, a valve seat having excellent strength and wear resistance can be provided.

BEST MODE FOR CARRYING OUT THE INVENTION

Figure 1:
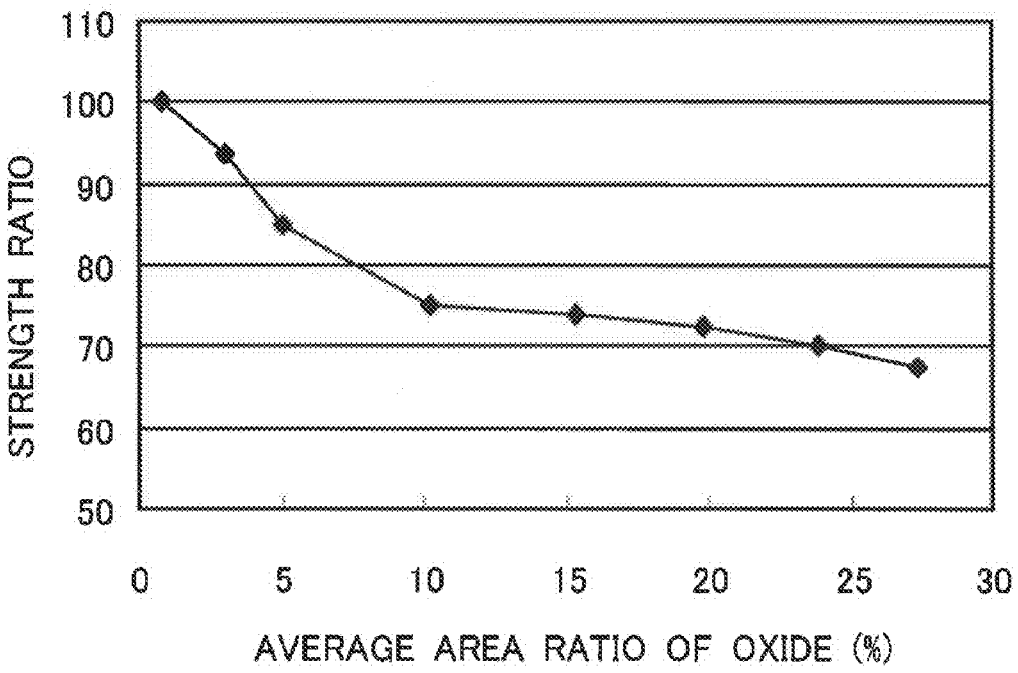
FIG. 1 is a graph illustrating the relationship between the average area ratio of the oxide mainly composed of triiron tetroxide and the strength ratio in the iron-based sintered alloy of composition 1.

The valve seat of the present invention is constituted by an iron-based sintered alloy in which an oxide mainly composed of triiron tetroxide is formed by oxidation treatment on the surface and interior.

In the present invention, it is necessary that the average area ratio of the oxide mainly composed of triiron tetroxide in a cross section of the iron-based sintered alloy in the state prior to installation on a cylinder head be 5 to 20%. It is preferably 7 to 15%. If the average area ratio of the oxide mainly composed of triiron tetroxide is in the abovementioned range, a valve seat having excellent strength and wear resistance can be produced. When the average area ratio exceeds 20%, the radial crushing strength is degraded and the valve seat is easily broken by the impact when a valve is seated therein. When the ratio is less than 5%, the wear resistance is inferior.

It should be noted that, in the present invention, as illustrated in the examples to be described, an optional cross section of the iron-based sintered alloy is observed by scanning electron microscope, an oxygen map is obtained from the observed image using an oxygen map of an energy-dispersive X-ray analyzer (EDX), the brightness of the obtained oxygen map data is binarized and the area ratio having a brightness of 5 or higher is obtained, and, the average value of N=3 locations/item×10 points is used as the average area ratio of the oxide mainly composed of triiron tetroxide.

In the present invention, the iron-based sintered alloy used in the valve seat preferably contains hard particles formed from at least one compound of carbides, silicides, nitrides, borides, and intermetallic compounds containing one or more elements selected from groups 4a to 6a of the periodic table. The average area ratio of the hard particles in a cross section of the iron-based sintered alloy in the state prior to installation on a cylinder head is preferably 5 to 45%, more preferably 15 to 45%. Compounding the abovementioned hard particles in the iron-based sintered alloy enables plastic flow of the valve seat to be suppressed and wear resistance to be further improved. When the average particle ratio of the hard particles exceeds 45%, the production characteristics tend to be inferior, the density of the iron-based sintered alloy tends to decrease, and the strength tends to be degraded. When the ratio is less than 5%, the additive effect on wear resistance is reduced.

It should be noted that, in the present invention, as illustrated in the examples to be described, an optional cross section of the valve seat is observed at 200 times using an optical microscope or an electron microscope, hard particle portions in the cross-sectional structural photograph in a range of 1 mm×1 mm are traced on a spreadsheet and the area is obtained, and the average value of the measured values in 4 locations is used as the average area ratio of the hard particles.

The hardness of the hard particles is preferably 600 to 1600 HV, more preferably 650 to 1400 HV. The wear resistance is insufficient when the hardness is less than 600 HV, and wear of the valve as an accompanied material increases when the hardness exceeds 1600 HV. It should be noted that, in the present invention, the hardness of the hard particles is a value measured based on JIS Z 2244 "Vickers hardness test—test method."

Specific examples of hard particles include: Fe—Mo (ferromolybdenum), Fe—Cr (ferrochrome), Co—Mo—Cr, and other intermetallic compounds; Fe-based, Co-based, or Ni-based alloys having dispersed carbides of Cr, Mo, and the like; Fe-based, Co-based, or Ni-based alloys having dispersed silicides of Cr, Mo, and the like; Fe-based, Co-based, or Ni-based alloys having dispersed nitrides of Cr, Mo, and the like; and Fe-based, Co-based, or Ni-based alloys having dispersed borides of Cr, Mo, and the like. In particular, Fe—Mo (ferromolybdenum), Fe—Cr (ferrochrome), Co—Mo—Cr, and other intermetallic compounds, and Fe-based, Co-based, or Ni-based alloys having dispersed carbides of Cr, Mo, and the like, have a hardness of 600 to 1600 HV and are preferably used.

The method for producing the valve seat of the present invention is not particularly limited; the valve seat can be produced, for example, as described hereunder.

An additive element (C, Cu, Ni, Cr, Mo, Co, P, Mn, or the like), hard particles, and a solid lubricant (calcium fluoride, manganese sulfide, molybdenum sulfide, tungsten sulfide, chromium sulfide, enstatite, talc, boron nitride, or the like) are admixed as optional ingredients into a raw material iron powder such as pure iron powder, Cr steel powder, Mn steel powder, MnCr steel, CrMo steel powder, NiCr steel powder, NiCrMo steel powder, tool steel powder, high-speed steel powder, Co alloy steel powder, and Ni steel powder.

The ratio in which the raw materials are mixed is not particularly limited. An example is 30 to 99% by mass of the raw material iron powder, 0 to 50% by mass of the hard particles, 0 to 20% by mass of the additive element, and 0 to 5% by mass of the solid. lubricant. The average area ratio of hard particles in a cross section of the iron-based sintered alloy can be increased by increasing the mixture ratio of hard particles. For example, the average area ratio of the hard particles in a cross section of the iron-based sintered alloy can be adjusted to 5 to 45% by adjusting the mixture ratio of the hard particles to 5 to 50% by mass.

The average particle size of the raw material iron powder is preferably 40 to 150 μm. When the average particle size is less than 40 μm, variation tends to arise in the density of the powdered compact due to a decrease of fluidity, and scattering tends to arise in the strength of the iron-based sintered alloy. When the average particle size exceeds 150 μm, caps between powder particles tend to increase, the density of the powdered compact tends to decrease, and the strength of the iron-based sintered alloy tends to decrease. It should be noted that the average particle size in the present invention is a value measured by laser diffraction/scattering particle size distribution analyzer.

The additive element is preferably added in the form of an oxide, carbonate, elemental unit, alloy, or the like. The average particle size is preferably 1 to 60 μm. When the average particle size is less than 1 μm, the additive element tends to aggregate and not be evenly distributed in the iron-based sintered alloy, and scattering tends to arise in the wear resistance of the iron-based sintered alloy. When the average particle size exceeds 60 μm, the additive element tends to be sparse in the iron-based sintered alloy, and scattering tends to arise in the wear resistance of the iron-based sintered alloy.

The average particle size of the hard particles is preferably 5 to 90 μm. When the average particle size is less than 5 μm, an effect, of suppressing plastic flow of the iron-based sintered alloy tends not to be obtained. When the average particle size exceeds 90 μm, the hard particles tend to be sparse in the iron-based sintered alloy, and scattering tends to arise in the wear resistance of the iron-based sintered alloy.

The average particle size of the solid lubricant is preferably 1 to 50 μm. When the average particle size is less than 1 μm, the solid lubricant tends to aggregate and not be evenly distributed in the iron-based sintered alloy, and scattering tends to arise in the wear resistance of the iron based sintered alloy. When the average particle size exceeds 50 μm, the compressibility tends to be impaired during molding, the density of the powdered compact tends to decrease, and the strength of the iron-based sintered alloy tends to decrease.

The raw material powder mixture is next filled into a mold and compression molded by molding press to prepare a powdered compact.

The powdered compact is next baked to prepare a sintered body, and is then subjected to oxidation treatment.

The baking conditions are preferably 1050 to 1200° C. and 0.2 to 1.5 hours.

The oxidation treatment is preferably steam treatment from the aspect of stability of the oxidizing atmosphere, but the method is not particularly limited provided that triiron tetroxide can be produced on the surface and interior of the iron-based sintered alloy, such as by being oxidized in an oxidizing atmosphere in a heating oven.

In the present invention, oxidation treatment is carried out so that, the average area ratio of the oxide mainly composed of triiron tetroxide in a cross section of the iron-based sintered alloy becomes 5 to 20%. The average area ratio of the oxide becomes greater when the oxidation treatment time is set longer, and the average area ratio of the oxide becomes smaller when the time is set shorter. Describing with a specific example, the average area ratio of the oxide can be controlled to 5 to 20% by steam treating for 0.2 to 5 hours at 500 to 600° C.

The iron-based sintered alloy having undergone oxidation treatment is next polished and scrape while turning to obtain a valve seat.

In the valve seat of the present invention, because of the formation of the oxide mainly composed of triiron tetroxide on the surface and interior of the iron-based sintered alloy, an oxide is easily formed on the surface contacting with a valve during operation, with the oxide formed in advance on the surface of the iron-based sintered alloy as a starting point. By forming the oxide on the surface contacting with the valve, metal contact between the valve and the valve seat is suppressed and wear resistance of the valve seat is improved. By controlling the average area ratio of the oxide mainly composed of triiron tetroxide in a cross section of the iron-based sintered alloy to 5 to 20%, the wear resistance can be improved while maintaining strength.

Since the valve seat of the present invention thus has excellent strength and wear resistance, the valve seat can be used favorably in diesel engines, LPG engines, CNG engines, alcohol engines, and the like.

The valve seat of the present invention may be constituted by the abovementioned iron-based sintered alloy alone, or may be a laminate with another material in which at least the surface contacting with a valve is constituted by the abovementioned iron-based sintered alloy. By forming as a laminate, a material cheaper than the iron-based sintered alloy can be selected for the other material and the material cost can be reduced.

EXAMPLES

<Measurement Methods>

Measurement of Average Area Ratio of Oxide

A portion of the cross section of the valve seat was extracted by scanning electron microscope, and an oxygen map of an energy-dispersive Xray analyzer (EDX) was used for measurement by the procedure below.

(1) The cut valve seat was embedded in resin, and the sample was polished using diamond grain.

(2) The scanning electron microscope used was "VE8800" (trade name, product of Keyence), and observation was performed at 500 times with 15 kV accelerated voltage.

(3) The EDX used was "INCA 250 XTK" (trade name, product of Oxford Instruments), and the EDX software used was "The Microanalysis Suite-Issue 18d, version 4.15" (product of Oxford Instruments).

(4) The electron microscopic image was taken into the EDX software at an image resolution of 512×384 pixels.

(5) X-ray collection was integrated 10 times, setting the process time scale setting to 6, the spectral range to 0 to 20 keV, the number of channels to 2 k, adjusting the collection count rate to 30% dead time, and the dwell time being 100% μs/pixel.

(6) Processing to join 2×2 pixels into 1 pixel was performed and the X-ray intensity was set to 4 times in order to enhance the contrast of the obtained oxygen map.

(7) After the processing in (6), the brightness of the oxygen map data was binarized and the area ratio having a brightness of 5 or higher was obtained using the area calculating function of the EDX software, and the average value of N=3 locations/item×10 points was used as the average area ratio of the oxide.

Measurement of Average Area Ratio of Hard Particles

Figure 8:
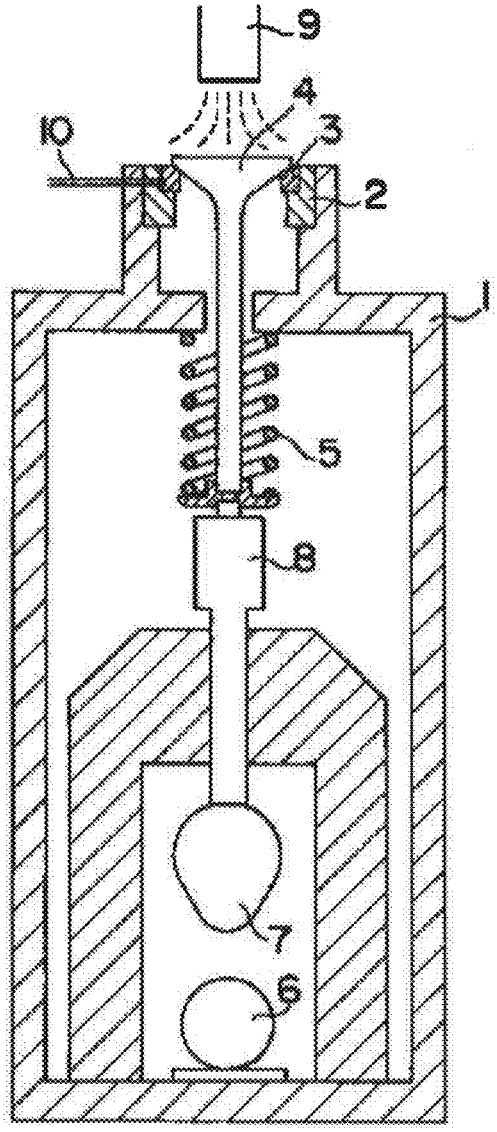
FIG. 8 is a schematic diagram of a valve seat wear test device.

A cross section of the iron-based sintered alloy was observed at 200 times using an optical microscope or an electron microscope, hard particle, portions in the cross-sectional structural photograph in a range of 1 mm×1 mm were traced on a spreadsheet and the area was obtained, and the average value of the measured values in 4 locations was used as the average area ratio of the hard particles, Wear Resistance Test of Valve Seat A valve seat 3 was attached to a valve seat wear test device illustrated in FIG. 8. Specifically, this valve seat wear test device is configured such that the face surface of a valve 4 is brought by a spring 5 into contact with the valve seat 3 fitted into a seat holder 2 on the upper end part of a frame 1. The valve 4 is lifted upward is a rod 8 by a cam shaft 7 rotated by an electric motor 6 and then returned by the spring 5 and thereby contacts the valve seat 3. The valve 4 is heated by a gas burner 9, the temperature of the valve seat 3 is measured with a thermocouple 10, and the temperature is controlled. During heating of the valve 4, the combustion state of the gas burner is set to complete combustion so that an oxide film does not grow on the surface. It should be noted that actual engine parts were used for the valve 4, spring 5, cam shaft 7, and the like.

The wear test was performed with the conditions listed in Table 1.

TABLE 1

| Iron-based sintered alloy | Composition 1, 3, and 4 | Composition 2 |
|---|---|---|
| Material of value 4 | SUH35 | Tribaloy coating |
| Set weight | 200 N | 280 N |
| Atmosphere | Low-oxygen atmosphere (nitrogen gas injected) | Low-oxygen atmosphere (nitrogen gas injected) |
| Offset between valve 4 and valve seat 3 | None | 0.2 mm |
| Temperature | 300° C. | 300° C. |
| Cam shaft rotation speed | 3500 rpm | 3500 rpm |
| Time | 2 hours | 2 hours |

Measurement of Radial Crushing Strength of Iron-based Sintered Alloy

Measurement was performed based on JIS Z 2507 "Method of testing radial crushing strength of sintered oil-containing hearings."

Measurement of Hardness of Iron-based Sintered Alloy

Measurement was performed based on JIS Z 2245 "Rockwell hardness test—test method."

Measurement of Density of Iron-based Sintered Alloy

Measurement was performed based on JIS Z 2501 "Sintered metal materials—methods of testing of density, oil content, and open porosity"

Test Example 1

Fe powder, hard particles, and a solid lubricant (manganese sulfide) were mixed respectively in ratios listed in Table 2, filled into a mold, and then compression molded using a molding press. The powdered compact thus obtained was baked for 0.5 hours at 1120° C. and an iron-based sintered alloy was obtained.

TABLE 2

| | Composition 1 | Composition 2 |
|---|---|---|
| Fe powder (average particle size 80 μm) | Balance | Balance |
| Hard particles 1 (composition: Fe—Mo, average particle size 25 μm) | — | — |
| Hard particles 2 (composition: Co—Mo—Cr, average particle size 35 μm | 5% by mass | 47.5% by mass |
| Solid lubricant (manganese sulfide, average particle size 5 μm) | — | 1.5% by mass |
| Average area ratio of oxide mainly composed of triiron tetroxide in cross section of iron-based sintered alloy before oxidation treatment | 0.7% | 0.9% |
| Hardness of iron-based sintered alloy before oxidation treatment | HRB 87 | HRB 102 |
| Density of iron-based sintered alloy before oxidation treatment | 6.9 | 6.8 |
| Average area ratio of hard particles in cross section of iron-based sintered alloy | 5% | 45% |

The iron-based sintered alloys were next subjected to steam treatment varying the conditions with a temperature range of 500 to 600° C. and range of heating time of 0.2 to 5 hours, and oxides mainly composed of triiron tetroxide were formed on the surface and interior of the iron-based sintered alloys with varied average area ratios. Iron-based sintered alloys having average area ratios of the oxides of 0%, 5%, 10%, 15%, 20%, 25%, and 30% thus were obtained.

Figure 2:
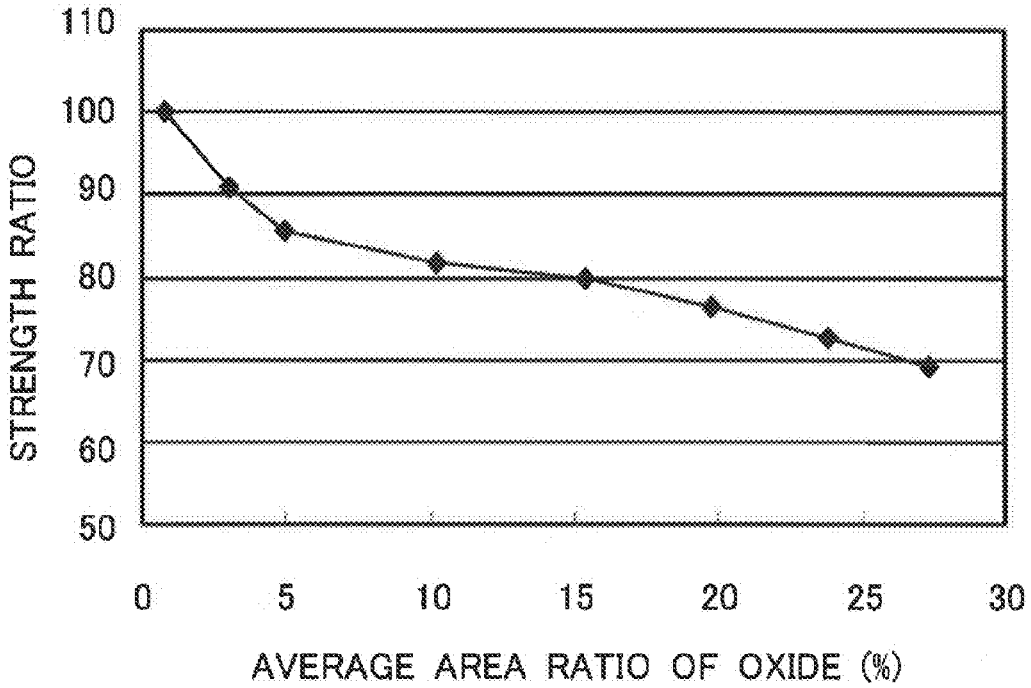
FIG. 2 is a graph illustrating the relationship between the average area ratio of the oxide mainly composed of triiron tetroxide and the strength ratio in the iron-based sintered alloy of composition 2.

The radial crushing strength was measured for the respective iron-based sintered alloys having varied average area ratios of oxides thus obtained. FIGS. 1 and 2 illustrate the relationship between the average area ratio of the oxide mainly composed of triiron tetroxide thus obtained and the strength ratio. FIG. 1 is the result of the iron-based sintered, alloy of composition 1 (5% average area ratio of hard particles), and FIG. 2 is the result of the iron-based sintered alloy of composition 2 (45% average area ratio of hard particles). It should be noted that the strong ratio is indicated as the relative value when 100 is the radial crushing strength of an iron-based sintered alloy not having undergone oxidation treatment.

Valve seats were next produced using the respective iron-based sintered alloys having varied average area ratios of oxides.

Figure 3:
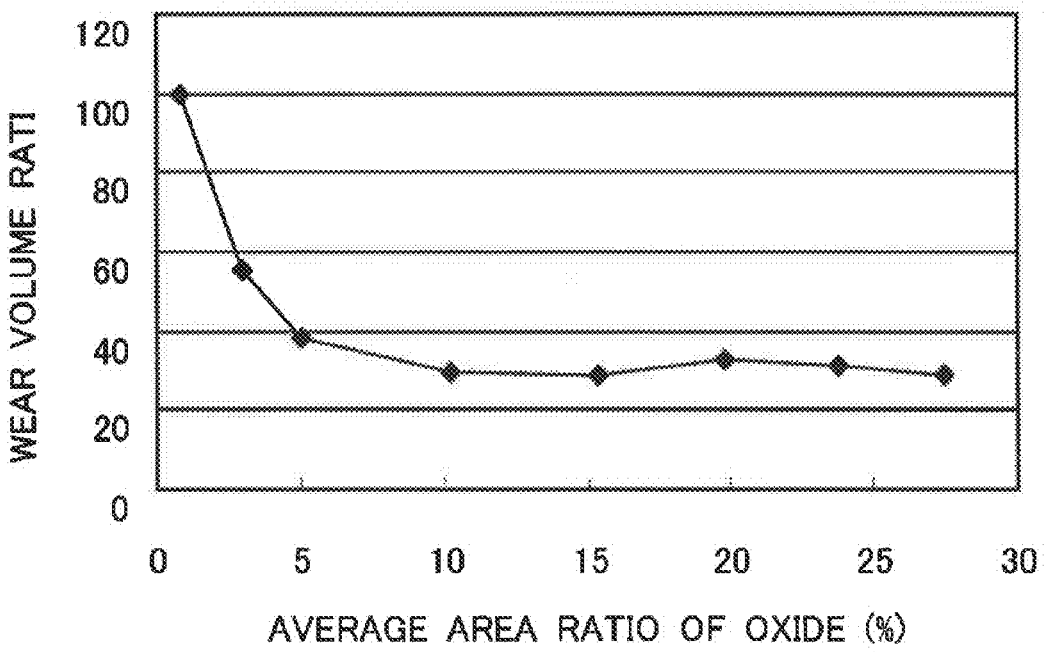
FIG. 3 is a graph illustrating the relationship between the average area ratio of the oxide mainly composed of triiron tetroxide and the wear volume ratio in the iron-based sintered alloy of composition 1.
Figure 4:
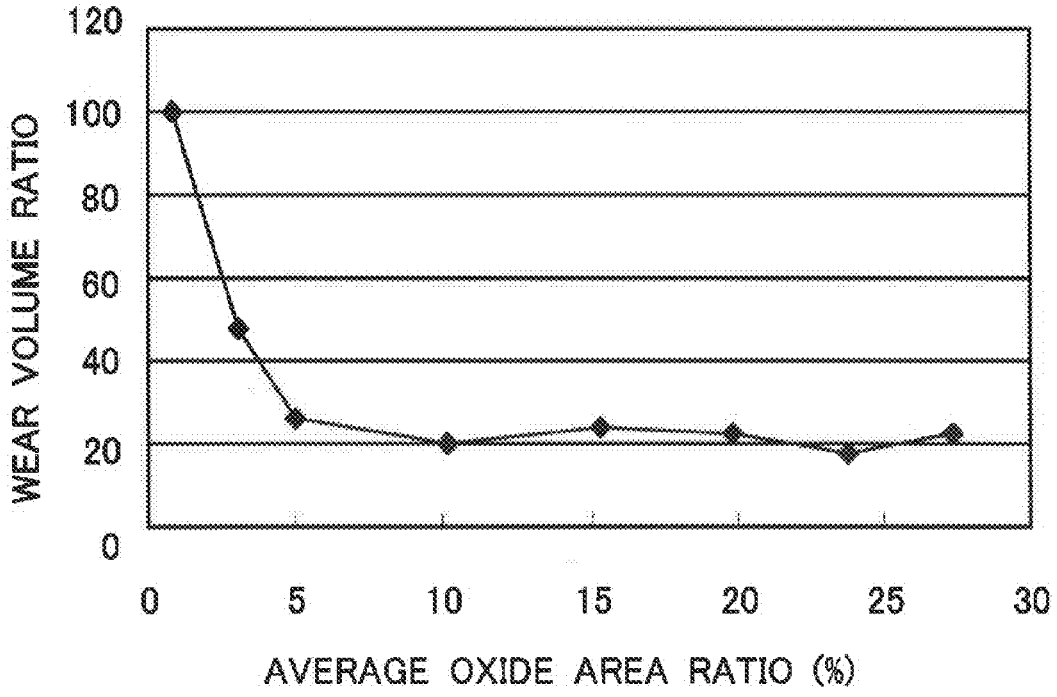
FIG. 4 is a graph illustrating the relationship between the average area ratio of the oxide mainly composed of triiron tetroxide and the wear volume ratio in the iron-based sintered alloy of composition 2.

Wear tests were performed using the obtained valve seats. FIGS. 3 and 4 illustrate the relationship between the average area ratio of the oxide mainly composed of triiron tetroxide thus obtained and the wear volume ratio. FIG. 3 is the result of the iron-based sintered alloy of composition 1 (5% average area ratio of hard particles), and FIG. 4 is the result of the iron-based sintered alloy of composition 2 (45% average area ratio of hard particles). It should be noted that the wear volume ratio is indicated as the relative value when 100 is the wear volume of an iron-based sintered alloy not having undergone oxidation treatment.

As illustrated in FIGS. 1 to 4, it is clear that when the average area ratio of the oxide mainly composed of triiron tetroxide is 5 to 20%, the radial crushing strength is great and a valve seat having excellent wear resistance can be obtained.

Meanwhile, when the average area ratio of the oxide main y composed of triiron tetroxide exceeds 20%, the radial crushing strength tends to decrease. When the average area ratio of the oxide mainly composed of triiron tetroxide is less than 5%, the wear volume tends to be great and the wear resistance tends to be inferior.

Test Example 2

Fe powder, hard particles, and a solid lubricant (manganese sulfide) were mixed respectively in ratios listed in Table 3, filled into a mold, and then compression molded by molding press to obtain a powdered compact. Baking was performed in the same manner as in test example 1, and iron-based sintered alloys were obtained.

TABLE 3

| | Composition 3 | Composition 4 |
|---|---|---|
| Fe powder (average particle size 80 μm) | Balance | Balance |
| Hard particles 1 (composition: Fe—Mo, average particle size 25 μm) | 5% by mass | — |
| Hard particles 2 (composition: Co—Mo—Cr, average particle size 35 μm) | 22.5% by mass | 32.5% by mass |
| Solid lubricant (manganese sulfide, average particle size 5 μm) | 1.5% by mass | 1.5% by mass |
| Average area ratio of oxide mainly composed of triiron tetroxide in cross section of iron-based sintered | 0.8% | 1.3% |

TABLE 3-continued

| | Composition 3 | Composition 4 |
|---|---|---|
| alloy before oxidation treatment | | |
| Average area ratio of oxide mainly composed of triiron tetroxide in cross section of iron-based sintered alloy after oxidation treatment | 9.8% | 11.5% |
| Average area ratio of hard particles in cross section of iron-based sintered alloy | 25% | 30% |

The iron-based sintered alloys were next subjected to steam treatment for 1 hour at a temperature of 550° C. Valve seats were produced respectively using iron-based sintered alloys having been subjected to the oxidation treatment and iron-based sintered alloys not having undergone oxidation treatment, and wear resistance tests were performed.

Figure 5A:
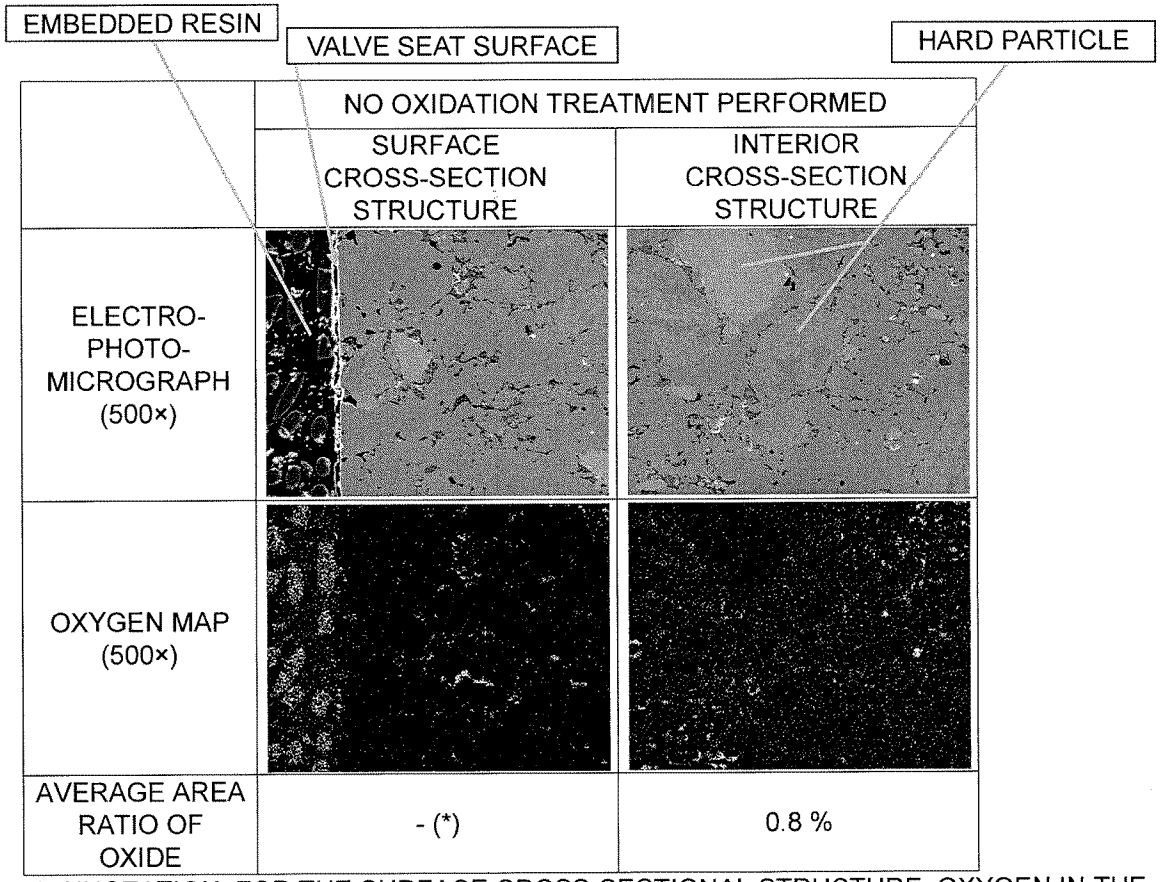
FIG. 5A depicts cross-sectional structural photographs and oxygen map images before oxidation treatment and before a wear resistance test of valve seats of composition 3.
Figure 5B:
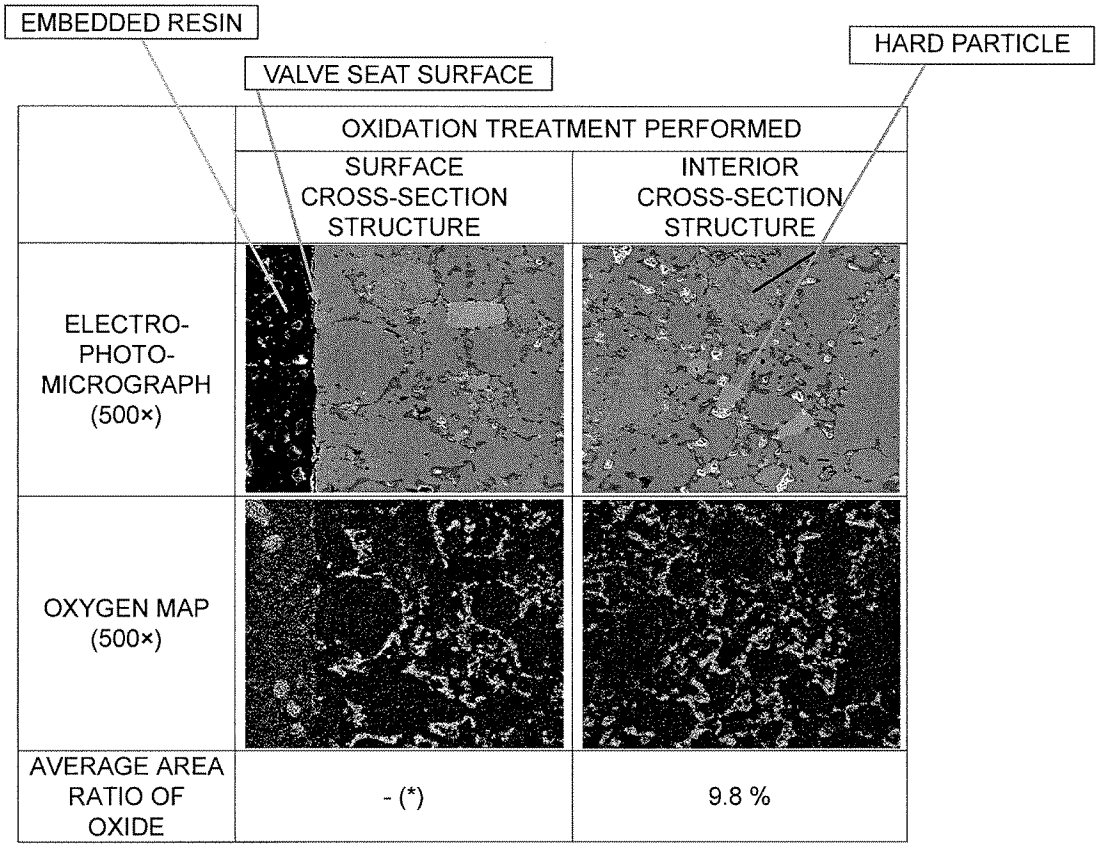
FIG. 5B depicts cross-sectional structural photographs and oxygen map images after oxidation treatment and after a wear resistance test of valve seats of composition 3.
Figure 6A:
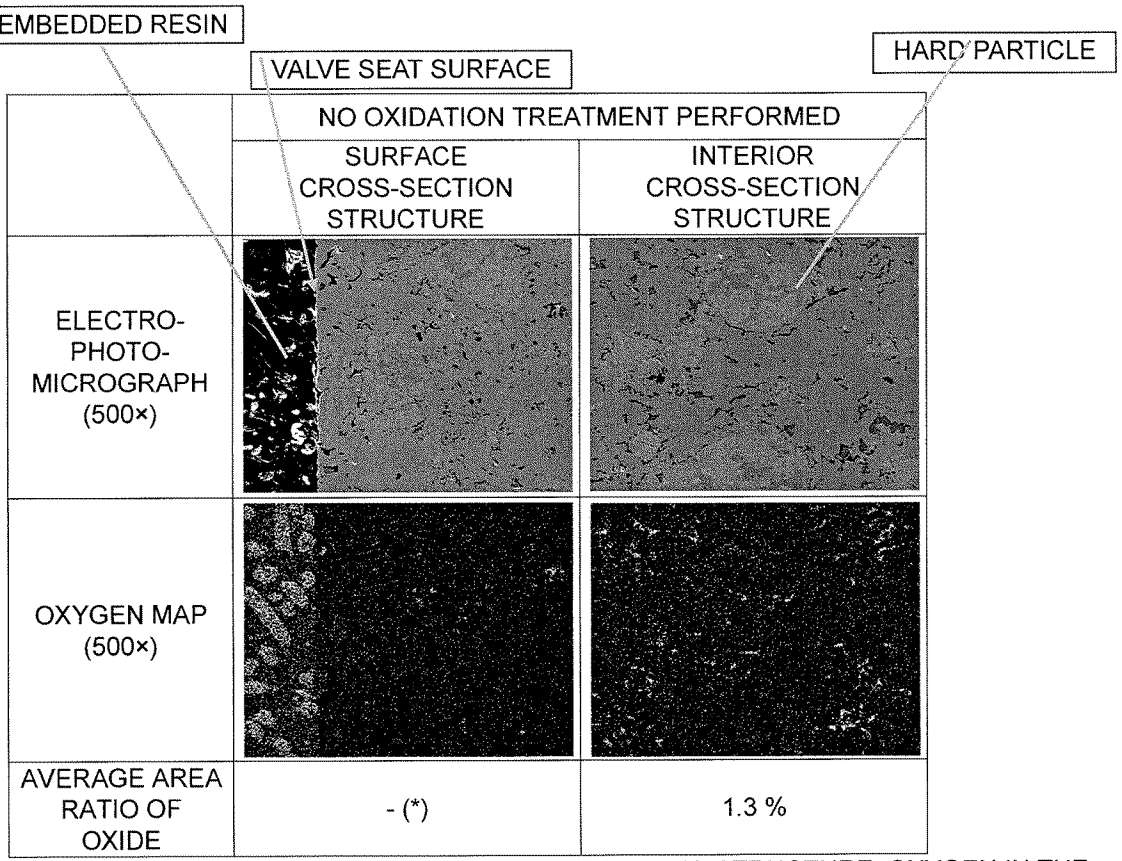
FIG. 6A depicts cross-sectional structural photographs and oxygen map images before oxidation treatment and before a wear resistance test of valve seats of composition 4.
Figure 6B:
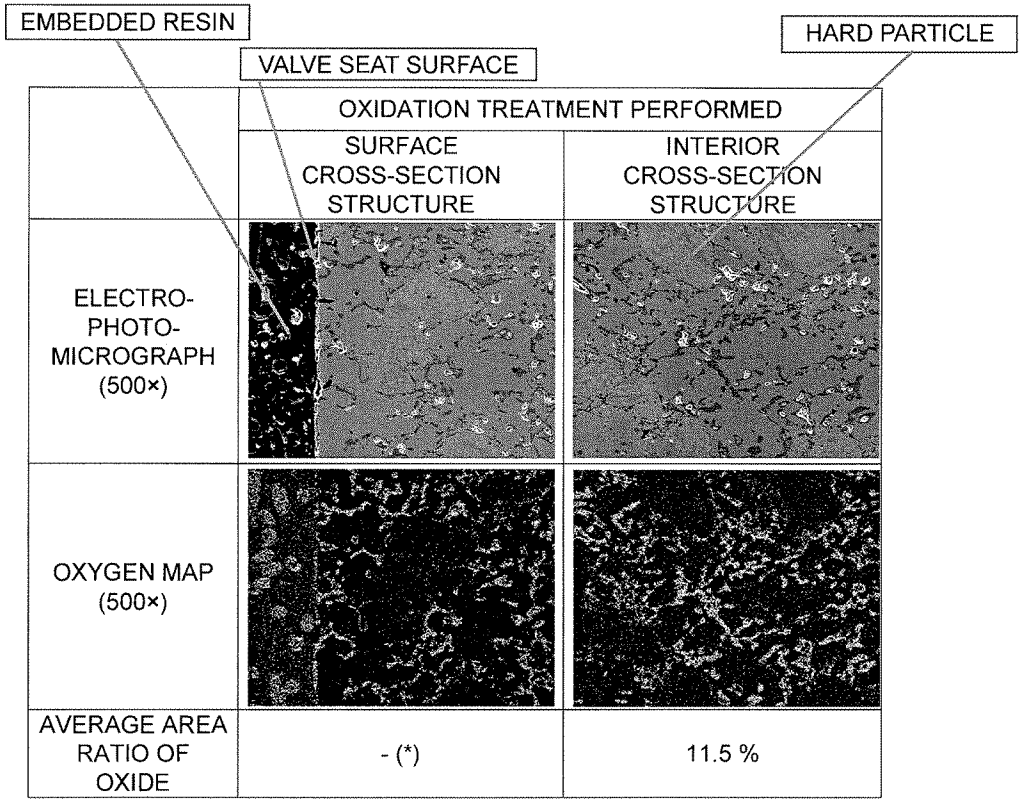
FIG. 6B depicts cross-sectional structural photographs and oxygen map images after oxidation treatment and after a wear resistance test of valve seats of composition 4.
Figure 7:
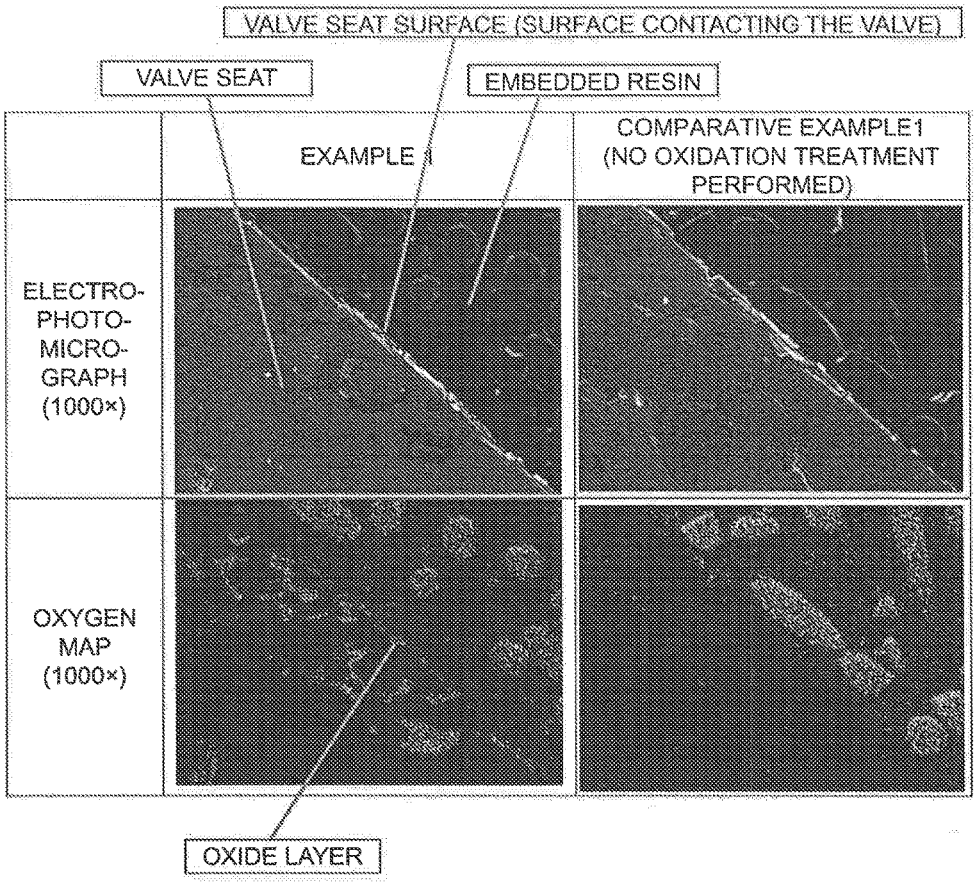
FIG. 7 depicts cross-sectional structural photographs and oxygen map images after a wear resistance test of valve seats of composition 3.

FIGS. 5A and 5B depict cross-sectional structural photographs and oxygen map images before the wear resistance test of valve seats of composition 3, and FIGS. 6A and 6B depict cross-sectional structural photographs and oxygen map images before the wear resistance test of valve seats of composition 4. FIG. 7 depicts cross-sectional structural photographs and oxygen map images after the wear resistance test of valve seats of composition 3.

As illustrated in FIGS. 5B and 6B, an oxide mainly composed of triiron tetroxide was formed on the surface and interior of the iron-based sintered alloy by performing oxidation treatment. It should be noted that the cross-sectional structure on the valve seat surface (the surface contacting with the valve) contained embedded resin and therefore was not subject to oxygen analysis, but in the iron-based sintered alloy having undergone oxidation treatment, the distribution of oxide in the cross-sectional structure inside was equivalent to that of the cross-sectional structure near the surface.

As is clear from comparison between FIGS. 5A and 5B and FIG. 7, in the valve seats using the iron-based sintered alloys having undergone oxidation treatment, compared with the valve seats using the iron-based sintered alloys not having undergone oxidation treatment, it was carried out that a large amount of oxide was formed on the surface contacting with the valve after the wear test, metal contact between the valve and the valve seat was suppressed, and the wear resistance of the valve seat was improved.

The invention claimed is:

1. A valve seat having a surface for contacting with a valve, the valve seat comprising: an iron-based sintered alloy having an interior and providing said surface for contacting with a valve; an oxide formed by oxidation treatment and mainly composed of triiron tetroxide, the oxide being on said surface and in said interior of the iron-based sintered alloy; and hard particles having a hardness of 600 to 1600 HV and being formed from at least one compound of carbides, silicides, nitrides, borides, and intermetallic compounds containing one or more elements selected from groups 4a to 6a of the periodic table, wherein in a cross section of said interior of the iron-based sintered alloy, an average area ratio of the oxide in the cross section is 5 to 20%, and an average area ratio of the hard particles in the cross section is 5 to 45%.

2. A valve seat as claimed in claim 1, wherein the average area ratio of the oxide is obtained by taking an image of the interior cross section by scanning electron microscope, obtaining an oxygen map from the microscope image by use of an energy-dispersive X-ray analyzer, binarizing brightness in the obtained oxygen map and obtaining the area ratio with a brightness of 5 or higher, and averaging measured area ratio values in each of ten points in three cross sections per one item of the valve seat.

3. A valve seat as claimed in claim 2, wherein the average area ratio of the hard particles is obtained by obtaining an image of the hard particles at four locations within the interior cross section, the image being obtained by observing at 200 times with use of an optical microscope or an electron microscope, tracing a hard particle portion in each image in an area of 1 mm×1 mm, and averaging measured area values of hard particles in the four locations.

4. A valve seat as claimed in claim 1, wherein the oxidation treatment comprises steam treating the iron-based sintered alloy for 0.2 to 5 hours at 500 to 600° C.

* * * * *